United States Patent [19]

Krause

[11] 3,937,400

[45] Feb. 10, 1976

[54] APPARATUS FOR SPRAYING PAINT

[75] Inventor: Janusz Josef Henryk Krause, Runcorn, England

[73] Assignee: Imperial Chemical Industries Limited, London, England

[22] Filed: Nov. 7, 1974

[21] Appl. No.: 521,932

[30] Foreign Application Priority Data

Nov. 26, 1973 United Kingdom ..... 54754/73

[52] U.S. Cl. ..... 239/11; 239/3; 239/15; 239/323; 222/334; 222/395

[51] Int. Cl.[2] ... B05B 17/04; B05B 9/04; B05B 5/02

[58] Field of Search ..... 239/3, 15, 88, 89, 93, 239/320, 323, 330, 1, 11; 222/334, 395

[56] References Cited

UNITED STATES PATENTS

| | | | |
|---|---|---|---|
| 1,824,952 | 9/1931 | Graham et al. | 239/11 |
| 2,513,455 | 7/1950 | Cornelius | 239/323 X |
| 2,585,172 | 2/1952 | Reynolds | 222/334 X |
| 2,731,297 | 1/1956 | Meyer | 239/323 X |
| 2,819,928 | 1/1958 | Liedberg | 222/334 UX |
| 2,881,959 | 4/1959 | Bitzer | 222/334 |
| 3,169,882 | 2/1965 | Juvinall et al. | 239/3 X |
| 3,227,314 | 1/1966 | Porter et al. | 222/334 X |

*Primary Examiner*—Robert S. Ward, Jr.
*Attorney, Agent, or Firm*—Cushman, Darby & Cushman

[57] ABSTRACT

Apparatus for spraying a predetermined amount of paint, especially electroconductive paint as used for coating metal anodes, which comprises in combination an electrostatic spray gun and a paint delivery device for the gun which operates on a single displacement diaphragm principle.

8 Claims, 3 Drawing Figures

APPARATUS FOR SPRAYING PAINT

Figures 1, 2, 3:
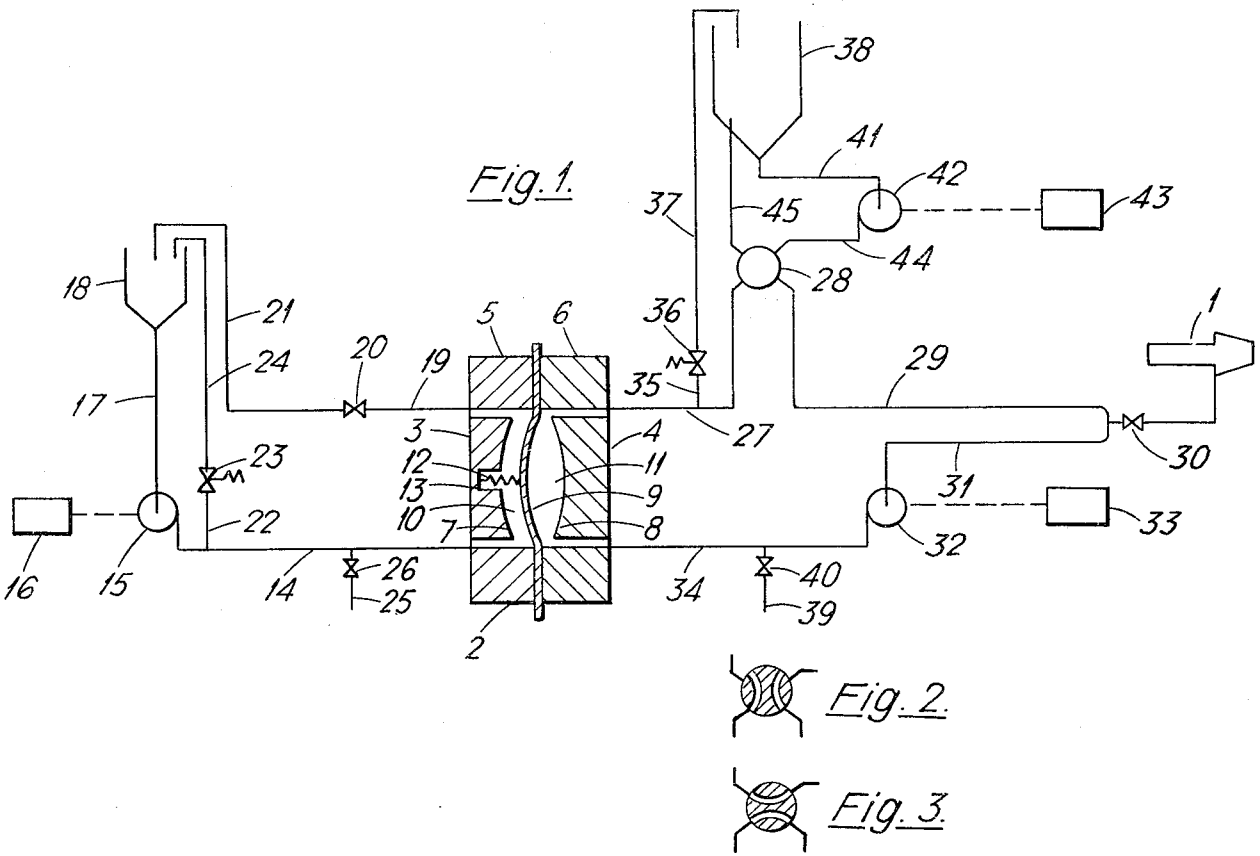

This invention relates to an apparatus for spraying paint.

The application of paint to a surface of an object by spraying from an air atomisation spray gun is a well known technique, but can lead to substantial losses of paint owing to a carry over of paint in the air flow into regions outside the actual area to be coated. These losses are especially important when using expensive paints e.g. the electroconductive paints used in the coating of titanium anodes for use in mercury cells. Such losses may be substantially reduced by the use of an electrostatic spraying technique in which the charged paint droplets are attracted to the object to be sprayed. In a conventional electrostatic spray gun, for example, the paint is fed to a gun charged at a high postive potential where it is atomised (e.g., by air pressure or by centrifugal action), and the object to be coated is earthed. It is important, however, to deliver paint to the spray gun at a steady and controllable rate in order to ensure that the object is uniformly coated with paint. In practice, this is not readily achieved. The use of a gravity feed of paint is unsatisfactory because of variations in flow associated with variations in the head of the paint being fed to the spray gun. The use of conventional diaphragm pumps is unsatisfactory because of the pulsating nature of the feed.

A more positive and efficient metering device is desirable to ensure the delivery of a predetermined amount of paint to a gun in a smooth and continuous manner at a controlled rate. Such a device is described in our copending UK Application No. 5237/73 which describes an apparatus which comprises in combination an electrostatic spray gun and a paint delivery device for the gun which operates on a piston and cylinder principle.

The aforesaid piston and cylinder device is not entirely satisfactory, however, when used to meter paint containing suspended solids. The efficiency of the metering device depends on the effectiveness of the sliding seal constituted by the piston and the cylinder walls and the presence of suspended solids in the paint can have an adverse effect on this seal by abrasive action on the piston. We have now devised an apparatus which avoids the use of a seal and which is advantageous for spraying a predetermined amount of paint, especially paint containing suspended solids, at a controlled rate.

According to the present invention we provide an apparatus for spraying a predetermined amount of paint at a controlled uniform rate which comprises in combination an electrostatic spray gun and a paint delivery device for the gun which operates on a single displacement diaphragm principle.

In a preferred apparatus, the paint delivery device comprises a diaphragm assembly comprising a casing, a flexible impermeable diaphragm sealed across the casing to define a pumping chamber and a pressurising chamber separated from one another by the diaphragm, porting to the pressurising chamber for the introduction and discharge of a pressurised fluid porting to the pumping chamber for the introduction and discharge of paint, and means for supplying a predetermined volume of pressurised fluid to the pressurising chamber whereby said diaphragm is flexed so as to discharge an equivalent volume of paint from the pumping chamber.

The casing preferably comprises two housings, one housing defining with one side of the diaphragm the pumping chamber and the other housing defining with the other side of the diaphragm the pressurising chamber. The housings are preferably recessed to define the aforesaid chambers by means of concave shaped inner walls facing the diaphragm. In use, the maximum movement of the diaphragm in each direction is limited by the diaphragm engaging with and closely conforming in shape to the aforesaid concave shaped walls. The movement of the diaphragm towards the inner wall of the pressurising chamber may be assisted, if desired, by means of a return spring connected between said wall and the facing side of the diaphragm.

The housings are conveniently provided with flanges to facilitate clamping together by conventional means, for example by use of bolts. The diaphragm is conveniently provided with a flat rim adapted to be held between the flanges.

The casing is conveniently made of any material which is resistant to both the paint composition and the pressurisable fluid. Suitable materials include plastics materials, for example polypropylene or polytetrafluoroethylene.

The diaphragm is conveniently made of any material which is deformable under pressure and which is resistant to both the paint composition and the pressurised fluid. Suitable diaphragms include those made of plastics and elastomers, especially diaphragms made of natural or synthetic rubber.

The porting to the pressurising chamber conveniently comprises an inlet which is operatively connected to the means of supplying a predetermined volume of pressurised fluid and to a source of the fluid to be pressurised, and an outlet for discharge of the pressurised fluid. The outlet includes a valve for closing the outlet when it is desired to pressurise the said chamber. If desired, the porting may comprise a common inlet and outlet which is connected to a separate inlet and outlet away from the pressurising chamber.

The means for supplying the predetermined volume of pressurised fluid, the porting to the pressurising chamber, the outlet valve and the source of fluid to be pressurised are conveniently in closed loop.

The means for supplying the predetermined volume of pressurised fluid is preferably a metering pump, especially a gear driven metering pump. The preferred pressurised fluid is a hydraulic fluid, for example a mineral oil.

The porting to the pumping chamber conveniently comprises an inlet for the paint which is operatively connected to a source of paint, and an outlet for the paint which is operatively connected to the electrostatic spray gun. The outlet is preferably provided with a valve for isolating the spray gun. It is preferred to circulate the paint in a closed loop comprising the source of paint, the inlet to and the outlet from the pumping chamber and the gun, in order to avoid settling of the solid constituents contained in the paint.

In practice it is preferred to fill the pumping chamber rapidly with paint, while discharging the said paint at a controlled and usually slow rate, said rate being predetermined by the rate of introduction of pressurised fluid to the pressurising chamber and the consequent displacement of the diaphragm.

The paint delivery device may be advantageously used to meter accurately very small flows, for example 1 to 5 ml/minute. The spraying may conveniently be operated in a batchwise manner by adjusting the rate of delivery to correspond to the overall spraying time required. The operation of the delivery device, including the opening and closing of the valves may be fully automated if desired.

An embodiment of the invention will now be described, simply by way of example, with reference to the accompanying drawing in which FIG. 1 is a schematic representation (part in section) of an electrostatic spray gun in association with a single displacement diaphragm device for delivering paint.

FIG. 2 is an enlarged view in vertical section of the valve 28 (shown schematically in FIG. 1) when in position for filling the diaphragm device with paint, and FIG. 3 is an enlarged view in vertical section of the valve 28 (shown schematically in FIG. 1) when in position for delivery of paint to the gun.

Referring to FIG. 1, the apparatus comprises an electrostatic spray gun 1 in combination with a diaphragm device (designated generally as 2). The gun 1 is provided with a rotating bell (not shown) for atomising paint delivered to the gun to a suitably high electric potential relative to the object to be sprayed.

The diaphragm device 2 comprises a casing having two housings 3, 4 which are bolted together (not shown) at flanges 5, 6. The housings 3, 4 are formed with recessed inner walls 7, 8 respectively. A flexible diaphragm 9 of a resilient material is sealed within the housings 3, 4 with its rim enclosed between flanges 5, 6. One side of the diaphragm 9 and the wall 7 constitute the pressurising chamber 10. The other side of the diaphragm 9 and the wall 8 constitutes the pumping chamber 11. A retaining spring 12 is connected between the diaphragm 9 and a recessed portion 13 of wall 7.

The pressurising chamber 10 is connected by inlet pipe 14 to the delivery side of a gear metering pump 15 driven by a motor 16. The suction side of pump 15 is connected by pipe 17 to the bottom of a head vessel 18 containing a hydraulic liquid as the source of pressurisable fluid. The pressurising chamber 10 is further connected by outlet pipe 19 through valve 20 and pipe 21 to the top of the head vessel 18. The pipe 14 is connected by pipe 22 through a pressure relief valve 23 and through pipe 24 to the top of the head vessel 18. The pipe 14 is further provided with a branch pipe 25 which passes to drain through valve 26.

The pumping chamber 11 is connected by outlet pipe 27 through a four-way valve 28, pipe 29 and thence through valve 30 to the gun 1 or through pipe 31 to the suction side of pump 32 (driven by motor 33). The delivery side of pump 32 is connected by inlet pipe 34 to the pumping chamber 11. The outlet pipe 27 is also connected by pipe 35 through pressure relief valve 36 and pipe 37 to the top of a head vessel 38 for paint (discussed below). The pipe 34 is provided with a branch pipe 39 which is connected to drain through valve 40.

The bottom of the head vessel 38 is connected by pipe 41 to the suction side of pump 42 (driven by motor 43). The delivery side of pump 42 is connected by pipe 44 through valve 28 and pipe 45 to the bottom of the head vessel 38.

Prior to filling the pumping chamber 11, the paint is circulated to and from the bottom of the head vessel 38 through pipe 41, pump 42, pipe 44, valve 28 (in the position as shown in FIG. 3) and pipe 45. At the same time, the pressurising chamber 10 may contain hydraulic fluid (e.g., when valve 20 is closed) whence the diaphragm 9 is positioned to the right of the centre line, conveniently conforming to the inner wall 8 of the pumping chamber 11.

The filling of the pumping chamber 11 with paint is carried out as follows. The valve 28 is turned to the position shown in FIG. 2, with valves 30 and 40 closed. The paint circulates from the bottom of the head vessel via pipe 41, pump 42, valve 28, pipes 29, 31, pump 32 and pipe 34 to the pumping chamber 11, and thence via pipe 27 through valve 28 and pipe 45 to the bottom of the head vessel 38. As the chamber 11 becomes filled with paint, the diaphragm 9 moves to the extreme left position to conform with the shape of the inner wall 7 (this movement being assisted by the return spring 12).

When it is desired to deliver the paint to the gun 1, the valve 28 is moved to the position shown in FIG. 3, and valves 28 and 20 are opened. The metering pump 15 is operated to deliver a predetermined volume of pressurised fluid at a controlled rate (e.g., at the rate of 1 to 5 ml/minute) to the pumping chamber 10 which causes the diaphragm 9 to move to the right thereby decreasing the volume of the pumping chamber 11 by an equivalent amount, which in turn results in the delivery of an equivalent volume of paint through 27, valve 28, pipe 29 and valve 30 to the gun 1.

It will be appreciated that when an electroconductive paint is used, it is necessary to isolate electrically the hydraulic system and the paint containing system. In practice, this may be achieved by insulating the shafts connecting the motor drives 33 and 43 to the pumps 32 and 42 respectively, and by making the pumps 32, 42, the head vessel 38 and the pipes on the paint delivery side of the diaphragm device 2 of a plastics material.

The invention is especially applicable to the spraying of electroconductive paints e.g., the electroconductive paints used for coating of titanium anodes for use in electrolytic cells. In particular the invention is applicable to the spraying of electroconductive paints containing suspended solids, for example electroconductive paints containing non-conducting particulate or fibrous refractory materials (e.g., zirconium silicate particles; zirconium silicate particles and zirconia fibres) in addition to substances which are thermally decomposable to the desired electroconducting coating.

The invention is further illustrated by the following examples

EXAMPLE 1

Two electrostatic spray guns were arranged, one above the other, so that one gun was directed on the top half of a titanium anode (14 in × 10.5 in) and the other gun was directed on the bottom half. An electroconductive paint composition was prepared consisting of ruthenium trichloride, n-pentanol, tetra-n-butyl orthotitanate and zirconium silicate (of median particle size 1.25 microns), in proportions corresponding to a final coating containing approximately 53% by volume of zirconium silicate and 47% by volume of titanium and ruthenium dioxides. The paint composition was fed at the rate of 3 ml/minute to each of the guns. At the same time, the titianium anode was moved transverse to the paint sprays at the rate of 1 ft/minute. After spraying, the anode was fired at 180°C to remove the pentanol and then fired in air at 450°C to convert the paint to ruthenium and titanium oxides admixed with zirconium silicate. The spraying and firing operations were repeated several times to give the desired thickness of electroconductive coating.

EXAMPLE 2

Example 1 was repeated using a paint composition containing ruthenium trichloride, n-pentanol, tetra-n-butyl orthotitanate, zirconium silicate of (median particle size 1.25 microns), and "Saffil" (a zirconia - containing fibre, diameter 2 microns, median length 20 microns, prepared as described in U.K. Pat. Application Nos. 12088/72 and 36693/72 and in U.K. Pat. Specification No. 1360197) corresponding to a final coating containing approximately (by volume) 19% $ZrO_2$ , 35% $ZrSiO_4$ and 46% $RuO_2/TiO_2$. The paint composition was again fed at the rate of 3 ml/minute to each of the guns.

What we claim is:

1. In a method of coating a metal anode with electroconductive paint with an electrostatic spray gun while maintaining said gun at a high electrical potential and said anode at ground potential, the improvement which comprises: providing a diaphragm assembly having a flexible diaphragm separating a paint pumping chamber containing sufficient paint to coat the entire surface of the electrode and a pressurizing chamber; connecting the pumping chamber to the spray gun; introducing non-compressible fluid into the pressurizing chamber at a uniform continuous non-pulsating rate so that the diaphragm flexes and delivers the paint in the pumping chamber to the spray gun at said uniform continuous non-pulsating rate; and spraying the delivered electroconductive paint from the spray gun onto the surface of the anode at said uniform continuous non-pulsating rate.

2. A method as in claim 1 wherein the paint is sprayed at a constant rate of between 1 and 10 ml/minute.

3. A method as in claim 1 wherein the paint is sprayed at a constant rate of between 1 and 5 ml/minute.

4. A method as in claim 1 wherein the paint comprises thermally decomposable compounds of a platinum metal and of a film-forming metal.

5. A method as in claim 1 wherein the paint comprises thermally decomposable compounds of a ruthenium compound and of a titanium compound.

6. A method as in claim 1 wherein the paint further comprises a non-conducting particulate or fibrous refractory material.

7. A method as in claim 6 wherein the refractory material comprises zirconium silicate particles.

8. A method as in claim 7 wherein the refractory material is a mixture of zirconium silicate particles and zirconia fibres.

* * * * *